United States Patent [19]

Williams

[11] Patent Number: 4,753,600

[45] Date of Patent: Jun. 28, 1988

[54] ROTATABLE ELECTRICAL CONNECTOR

[76] Inventor: O. V. Williams, Rte. #2 Box 729, Sophia, N.C. 27350

[21] Appl. No.: 47,120

[22] Filed: May 8, 1987

[51] Int. Cl.[4] ..... H01R 39/02

[52] U.S. Cl. ..... 439/22

[58] Field of Search ..... 439/21, 22, 24

[56] References Cited

U.S. PATENT DOCUMENTS 1,174,379 3/1916 Bacon ..... 439/21 X 4,026,618 5/1977 Straka ..... 439/21

FOREIGN PATENT DOCUMENTS 674434 6/1952 United Kingdom ..... 439/21

*Primary Examiner*—Eugene F. Desmond

[57] ABSTRACT

An electrical connector is provided for use with hand tools or the like that are normally joined to drop cords. The connector is placed between the drop cord and the electrical supply cord of the tool and allows the supply cord to be turned in a continuous clockwise or counter-clockwise direction without rotation of the drop cord or twisting of the supply cord. The connector of the invention includes a pair of opposing plates which are rotatably connected whereby during rotation electrical current passes through both plates without interruption thus allowing the tool to be continuously used during an eight hour work period with the tool being directed in the same circular motion without concern of twisting or effective shortening of the supply cord.

3 Claims, 2 Drawing Sheets

ROTATABLE ELECTRICAL CONNECTOR

BACKGROUND OF THE INVENTION

1. Field of the Invention

The present invention relates to an electrical connector for use with conventional hand tools such as jigsaws, electrical scissors, sanders, buffers or the like which may be moved in a circular motion such as a counterclockwise direction during use as may be required over a work day in manufacturing or maintenance operations. The invention can be for example connected between the electrical supply cord of the tool and a drop cord connected to a power source to prevent the supply cord from twisting and possibly being damaged as the tool is directed continuously in circles.

2. Description of the Prior Art and Objectives of the Invention

Various attempts have been made in the past to prevent electrical supply cords from twisting and being damaged by operators who must direct power hand tools in continous circular patterns. For example, in the manufacture of round table tops, jigsaws are often employed to cut wood or plyboard and such materials may be cut with a hand-held electrical jigsaw in a continuous counterclockwise direction. After one or more tops are cut the operator must stop and untwist the electrical supply cord which may be suspended from an overhead power source. In use, after sufficient twisting has occurred, the power supply or drop cord may be damaged and has to be repaired or replaced at great expense. Continuous circular movement of power hand tools normally occurs in furniture manufacturing, cloth cutting in garment plants and in other types of manufacturing and maintenance facilities.

With the known problems associated with electrical supply cord twisting, the present invention was conceived and one of its objectives is to provide a rotatable electrical connector which is easy to install between an electrical supply cord and a power hand tool and which can be readily adapted to a variety of power hand tool uses.

It is another objective of the present invention to provide a rotatable electrical connector which is relatively simple in construction yet which will provide convenience to the user and will prevent windings in supply cords when a hand tool is operated in a circular direction.

It is still another objective of the present invention to provide a rotatable electrical connector for electrical supply cords which can be easily manufactured for various voltages and which is equipped with a ground wire.

Other objectives and advantages of the present invention become apparent to those skilled in the art as a more detailed explanation of the invention is presented below.

SUMMARY OF THE INVENTION

The aforementioned and other objectives are achieved by providing an electrical connector having a pair of opposing rotatable plates which are joined together by an axle around which the plates rotate. Each plate includes electrical conductors which are aligned to provide contact between the conductors on opposing plates to maintain continuous current flow during rotation thereof. The connector can be joined, for example between a drop cord and a hand tool supply cord and as the hand tool is moved in a circular motion such as in cloth cutting, the plates of the connector rotate thereby preventing the supply cord of the hand tool from twisting and being damaged or being inconveniently wound and directionally shortened during use.

DESCRIPTION OF THE PREFERRED EMBODIMENT

Figure 2:
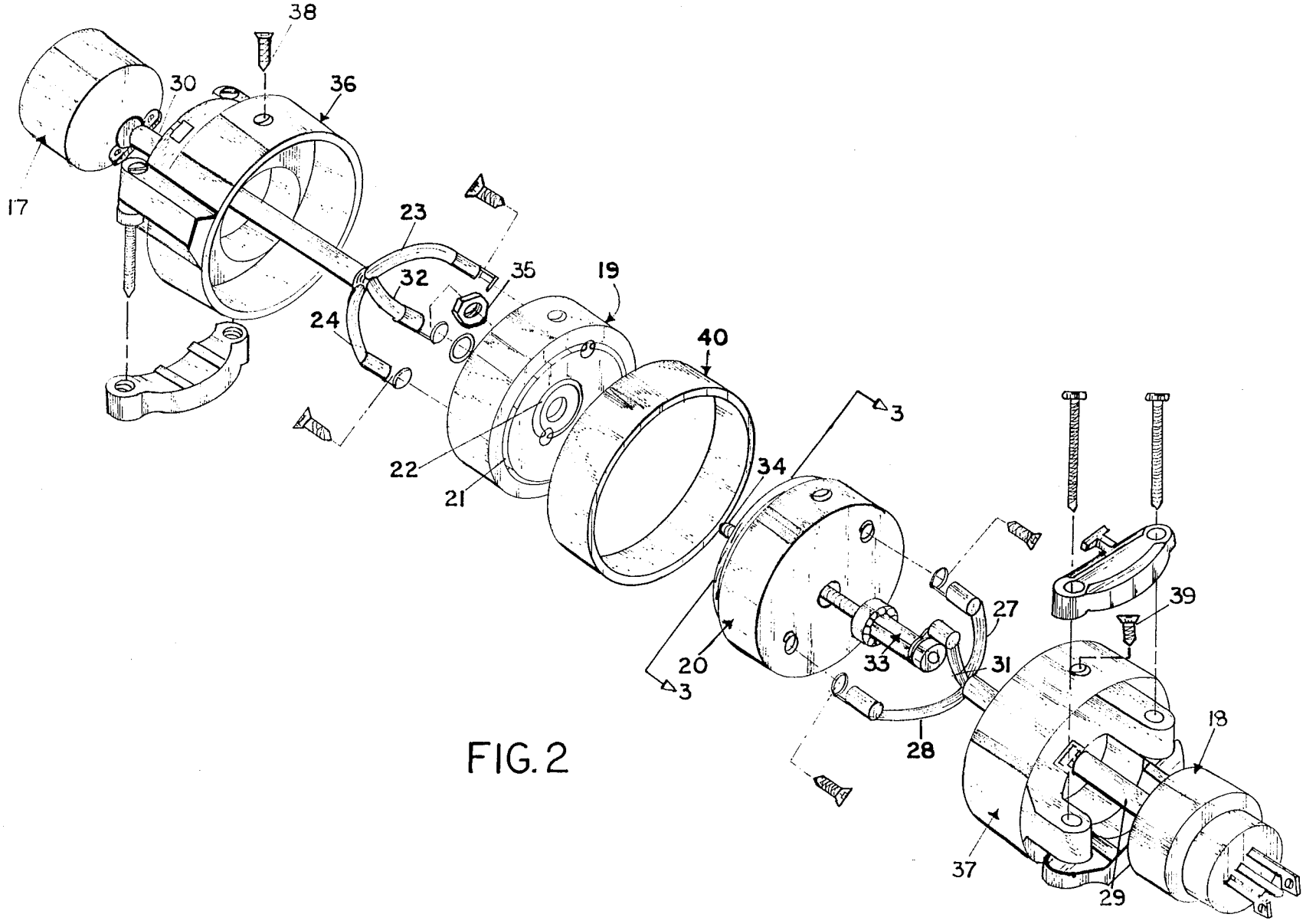
FIG. 2 illustrates an exploded view of the electrical connector.

The preferred form of the invention is shown exploded in Fig. 2 in which an electrical connector is illustrated having a pair of rotatable plates with conducting means thereon. If one or both plates rotate electrical contact is maintained between the conducting means and current is passed therethrough uninterrupted since the conducting means of one plate remains in electrical contact with the conducting means of the other plate during said rotation. The conducting means shown consists of a circular copper ring devised to carry the electrical load needed. The opposing plates are disk-shaped and may be made of wood or other non-conducting materials and are joined by a axle passing through the center of each and suitably secured to maintain contact during rotation between the opposing electrical conductors. The axle may be formed from a steel or copper threaded rod and is employed as a ground connector between the male and female terminals which are joined to the opposing plates. Plastic housing members are positioned over the opposing plates and a housing band which is also formed of plastic provides a seal around the plates between the housing members.

DETAILED DESCRIPTION OF THE DRAWINGS AND OPERATION OF THE INVENTION

Figure 1:
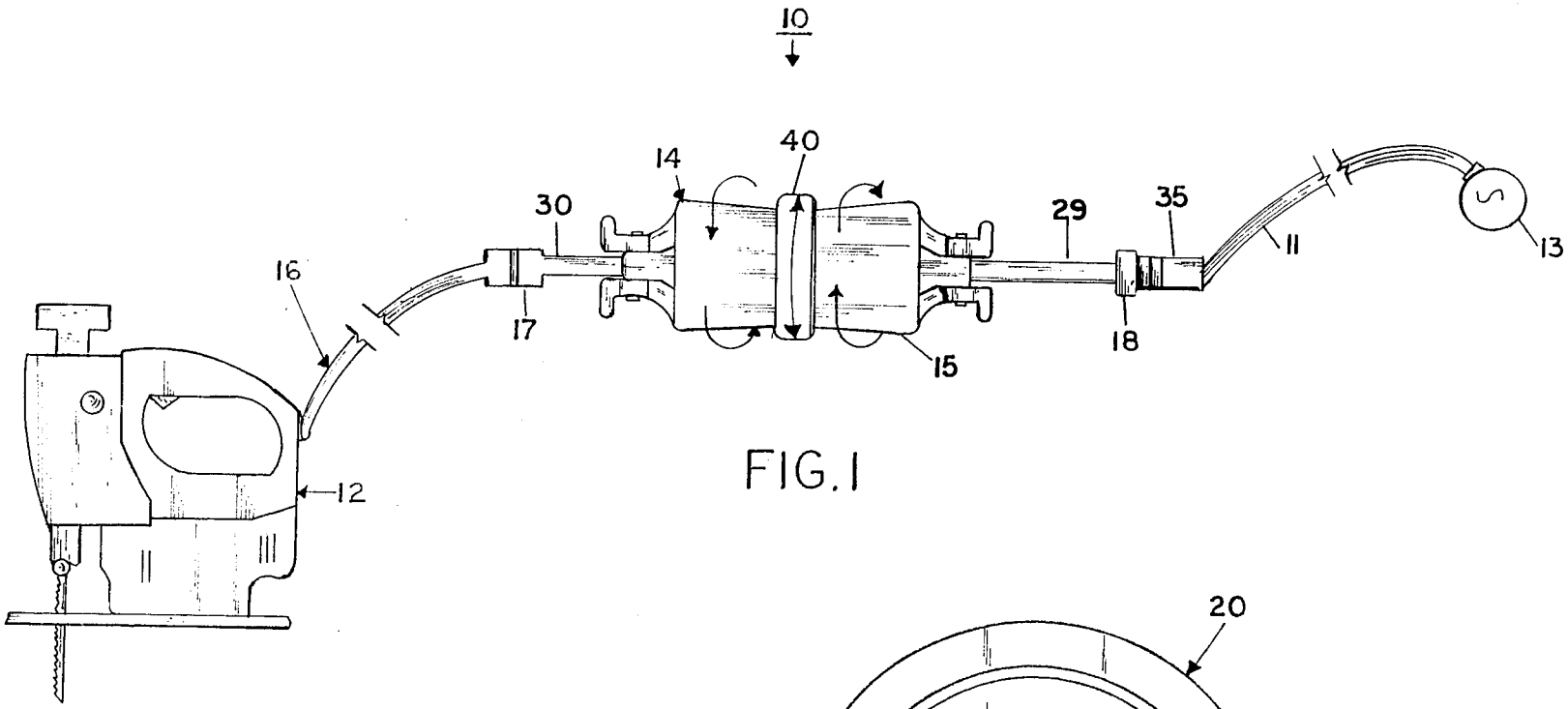
FIG. 1 demonstrates a side elevational view of the rotatable electrical connector in schematic fashion.

Turning now to the drawings as depicted to FIG. 1, rotatable electrical connector 10 is shown between drop cord 11 and power jigsaw 12. Drop cord 11 is joined to a 110 volt alternating power source 13 and includes female terminal 35. As shown by the arrows on rotatable electrical connector 10, left side 14 of connector 10 can move in a counterclockwise direction while right side 15 and other components (not shown in FIG. 1) can move in a clockwise direction without interruption of current flow from alternating source 13 to jigsaw 12. In use, jigsaw 12 can be used by sawing in a counterclockwise direction of 360° without any twisting or binding occurring in tool supply cord 16 or drop cord 11 due to the rotation by the connector. As further shown in FIG. 1, connector 10 includes a female terminal 17 and a male terminal 18, of which should be understood may be varied depending on the particular voltage or terminal configuration required.

Figure 3:
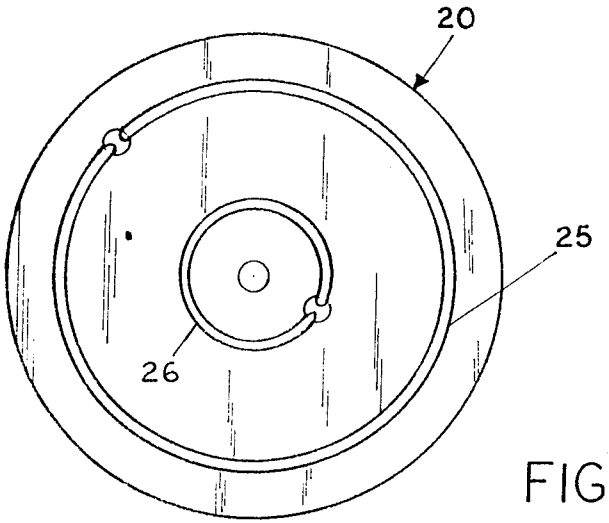
FIG. 3 show an end view of one of the pair of rotatable plates as shown along lines 3—3 of FIG. 2.

For a more complete understanding of the structure of the invention, FIG. 2 demonstrates in exploded fashion left plate 19 and right plate 20 which may be formed for example from plastic, wood or other non-conducting materials. Left plate 19 has positioned thereon conducting means 21 and 22 which consist of circular rings formed from copper wire which are spaced from each other to prevent electrical contact. Outer left copper circular ring or conducting means 21 is joined to lead-out wire 23 and inner left copper circular ring or conducting means 22 is joined to lead-out wire 24. On right plate 20 aligned in opposing fashion (not shown in FIG. 2 but shown in FIG. 3) outer right copper circular ring 25 and inner right copper circular ring 26 are depicted. As would be understood, when connector 10 is assembled as shown in FIG. 1, outer conducting means 25 abuts outer conducting means 21 and inner conducting means 26 abuts inner conducting means 22 to provide electrical contact therewith. As would also be understood, conducting means 21, 22, 25 and 26 are formed from copper wire of sufficient diameter to meet the electrical requirements although other materials or configurations may be employed.

As would be understood from FIG. 2, outer conducting means 25 is joined to lead-in wire 27 and inner conducting means 26 is joined to lead-in wire 28. Lead-in wires 27 and 28 together with ground wire 31 form the components of lead-in cord 29 whereas lead-out wire 23, lead-out wire 24 and ground wire 32 form lead-out cord 30. Ground wire 31 is joined to ground wire 32 by axle 33 which passes through the center of right plate 20 and left plate 19 where its threaded portion 34 is secured by tap 35 as seen in FIG. 2. Grounding means or wires 31 and 32 are in electrical contact with but are free to pivot around axle 33 during rotation of connector 10. Left housing 36 is formed from a non-conducting plastic material and is dimensioned to slide over left plate 19 and is secured thereto with securing means 38. Right housing 37 slides over right plate 20 and is affixed thereto by securing means 39. Housing band 40 has substantially the same inner dimensions as housings 36 and 37 to fit between right housing 37 and left housing 36 but will turn freely therebetween but will not move laterally from its central position as shown in FIG. 1 when connector 10 is assembled.

Various changes and modifications can be made to the invention by those skilled in the art and the drawings and illustrations presented herein are for illustrative purposes and intended to limit the scope of the appended claims.

I claim:

1. An electrical connector comprising: a pair of opposing rotatable plates, each of said plates including a pair of conducting means positioned thereon with each of said pair of conducting means on one of said pair of plates in electrical contact with the other of said pair of conducting means on the other of said pair of plates, a pair of lead-in wires, said pair of lead-in wires joined to said pair of conducting means on one of said plates, a pair of lead-out wires, said pair of lead-out wires joined to the other of said pair of plates, a pair of non-conducting housing members, each of said pair of housing members joined to one of said pair of rotatable plates for enclosing said plates, a housing band, said band freely rotatably positioned exteriorly around the outer surface of said pair of housing members to seal said plates, an axle, said axle joined to each of said plates whereby said plates can rotate around said axle and electrical current can pass through said lead-in wires to said lead-out wire without interruption during rotation of said plates.

2. An electrical connector as claimed in claim 1 wherein said axle includes electrical current grounding means.

3. An electrical connector comprising: a pair of opposing rotatable plates, each of said plates including a pair of conducting means positioned thereon with each of said pair of conducting means on one of said pair of plates in electrical contact with the other of said pair of conducting means on the other of said pair of plates, a pair of lead-in wires, said pair of lead-in wires joined to said pair of conducting means on the other of said pair of plates, a pair of lead-in wires, said pair of lead-in wires joined to said pair of conducting means on one of said plates, a pair of lead-out wires, said pair of lead-out wires joined to the other of said pair of plates, a pair of non-conducting housing members, each of said pair of housing members joined to one of said pair of rotatable plates to enclose said plates, a housing band, said band freely rotatably positioned exteriorly around the outer surface of said pair of housing members to seal said plates, an axle, said axle joined to each of said plates whereby said plates can rotate around said axle and electrical current can pass through said lead-in wire to said lead-out wire without interruption during rotation of said plates, said axle includes electrical current grounding means.

* * * * *